United States Patent [19]

Honma et al.

[11] Patent Number: 4,707,196

[45] Date of Patent: Nov. 17, 1987

[54] TI-NI ALLOY ARTICLES HAVING A PROPERTY OF REVERSIBLE SHAPE MEMORY AND A METHOD OF MAKING THE SAME

[75] Inventors: Toshio Honma; Minoru Nishida; Kiyoshi Yamauchi, all of Sendai, Japan

[73] Assignee: Tohoku Metal Industries Ltd., Miyagi, Japan

[21] Appl. No.: 773,435

[22] Filed: Sep. 6, 1985

Related U.S. Application Data

[63] Continuation of Ser. No. 470,532, Feb. 28, 1983, abandoned.

[51] Int. Cl.[4] ..... C22F 1/10

[52] U.S. Cl. ..... 148/12.7 N; 148/402; 148/409

[58] Field of Search ..... 148/402, 409, 2, 12.7 N

[56] References Cited

PUBLICATIONS

Takezawa, et al.—J. Japan Inst. Met. 43, (1979), p. 229.

*Primary Examiner*—R. Dean

*Attorney, Agent, or Firm*—Roberts, Spiecens & Cohen

[57] ABSTRACT

A reversible shape memory (R.S.M.) article of Ti-Ni alloy containing excess Ni over the stoichiometric composition, such as containing 50.3–53.0 at. % Ni which has a dual phase structure of a TiNi compound phase and a precipitated Ni rich compounds phase and the improved R.S.M. property wherein the different two shapes are recovered by thermal cycles between two temperatures sufficient higher and lower than the martensitic transformation temperature (Ms). The alloy prepared by the melting method is heat-treated at 600° C. or more to be made into a single phase of TiNi compound after being worked into a strip plate, and the plate is fixedly wound on a pipe and aged at 300° C.–600° C. for one or more hours, whereby the article having the R.S.M. property with a large amount of shape change by thermal cycles can be obtained.

9 Claims, 9 Drawing Figures

FIG. 5a
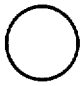
FIG. 5b
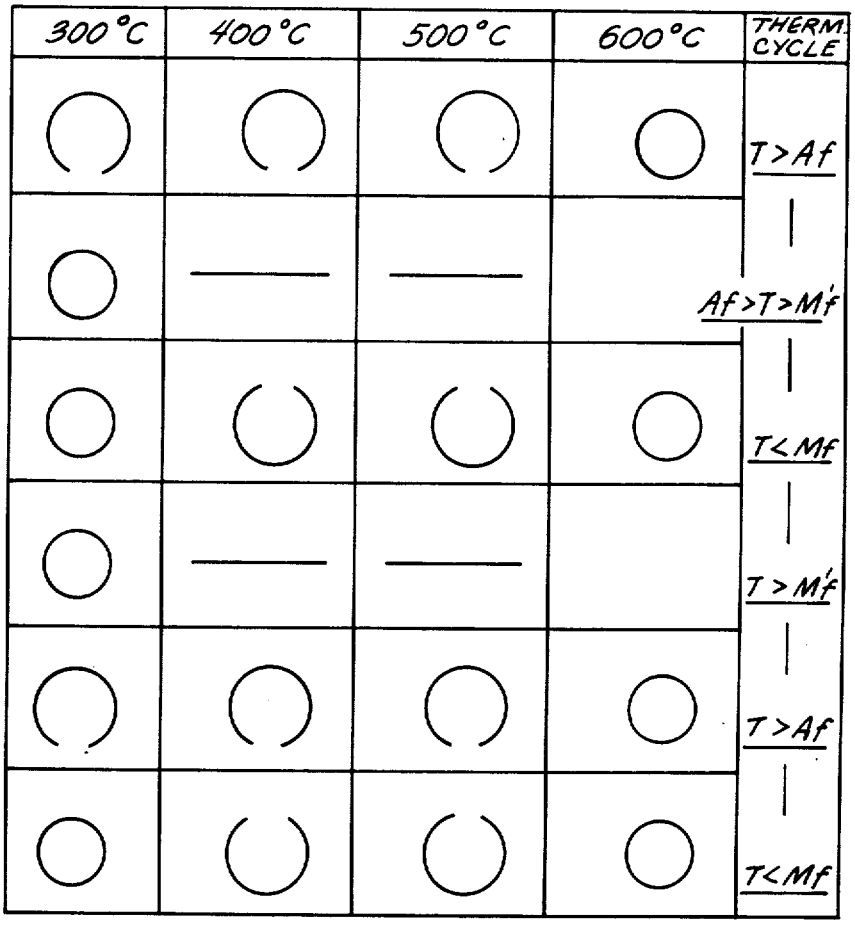
FIG. 6

TI-NI ALLOY ARTICLES HAVING A PROPERTY OF REVERSIBLE SHAPE MEMORY AND A METHOD OF MAKING THE SAME

This is a Continuation on, application Ser. No. 470,532 filed Feb. 28, 1983, Abandoned.

BACKGROUND OF THE INVENTION

This invention relates to Ti-Ni alloys having a shape memory effect, and in particular, to Ti-Ni alloy articles having a reversible shape memory effect and to a method for making the articles.

It is known in the prior art that Ti-Ni alloy has a unique property which is referred to as, so called, "shape memory effect" (S.M.E.). That is, when the alloy having a certain shape is deformed at an appropriate temperature and then heated to a sufficient high temperature, the alloy rapidly recovers the original shape (see U.S. Pat. No. 3,174,851 by Buehler et al).

Since the S.M.E. of Ti-Ni alloy was published by Buehler et al in Journal of Applied Physics, 34 (1963), 1467, many peoples have researched the mechanism of the S.M.E. in Ti-Ni alloy. However, it has not been yet sufficiently elucidated, although the S.M.E. is generally thought to be based on the martensitic transformation of the alloy.

It is known that the Ti-Ni alloy can have additions such as Fe, Cu, or others.

The S.M.E. of Ti-Ni alloy is expected to be applied onto various fields and has been practically used in several applications, but it is disadvantageously one-way in its shape recovery, that is, the original shape at a temperature higher than the temperature (As) for reverse transformation of the martensitic transformation of the alloy is recovered by heating from a lower temperature than As but the shape at the lower temperature is not recovered by cooling from the higher temperature.

If it is possible to provide a two-way shape memory effect or a reversible shape memory effect (R.S.M.E.) to Ti-Ni alloy wherein the original shape at a higher temperature is recovered by heating from a lower temperature while another shape at a lower temperature is also recovered by cooling from the higher temperature, application fields of Ti-Ni alloy may be extended.

As disclosed in "On the Mechanism of Reversible Shape Memory Effect in Cu-Zn-Al Alloys" by Takezawa and Sato, PROCEEDING OF THE INTERNATIONAL CONFERENCE ON MARTENSITIC TRANSFORMATIONS 1979, p.p. 655-660, in studies on shape memory alloys such as Ti-Ni, Cu-Zn-Al-Ti, Cu-Zn-Ga, Ni-Al, Cu-Zn and Cu-Zn-Al alloys the R.S.M.E. were produced by the severe deformation. That is, the R.S.M.E. is provided to such a shape memory alloy by severely deforming the alloy under its martensite condition to introduce an irreversible defect such as a dislocation into the alloy which does not disappear by the reverse transformation.

It is also disclosed in British Pat. No. 1,315,652 to provide the R.S.M.E. to Ti-Ni alloy by severely deforming the alloy at a temperature above the martensitic transformation temperature. The deformation is regenerated by cooling the alloy below the martensitic transformation temperature. Takezawa and Sato also disclose that the R.S.M.E. can also be generated by heating deformed specimens of Cu-Zn-Al alloy under constraint. The similar manner is disclosed in the paper "Effect of Applied Stress on the Character of Reversible Shape Memory in Cu-Zn-Al Alloy" by Takezawa, Edo and Sato, in the same publication p.p. 661-666.

According to the heating method under constraint by Takezawa et al., the heating temperature is comparatively low, for example, 100° C. as disclosed in the paper, page 662, line 7.

In another paper, J. Japan Inst. Met., 43 (1979), p.229, which is cited in the paper of Takezawa et al. it is disclosed that the heating temperature is about 60°-180° C.

However, the low heating method by Takezawa cannot provide to the Ti-Ni alloy the R.S.M.E. sufficient in the amount of shape memory.

SUMMARY OF THE INVENTION

Therefore, it is an object of this invention to provide Ti-Ni alloy articles having the reversible shape memory effect (R.S.M.E.) of the large amount of shape change.

It is another object of this invention to provide a method for making a Ti-Ni alloy article with the R.S.M.E. having the large amount of shape change.

It is still another object of this invention to provide a method for making a Ti-Ni alloy article with the R.S.M.E. wherein the amount of shape change can be readily controlled.

The Ti-Ni alloy article according to this invention is made of a Ti-Ni alloy which consists essentially, by atomic percent, of 50.3-53.0 % Ni and the balance substantially Ti. The alloy of the article has a dual phase structure wherein Ni rich intermetallic compounds (for example $TiNi_3$) are dispersed in one another, or intermixed. The alloy article has a first memorized shape at a temperature higher than the temperature (As) for the reverse transformation of the martensitic transformation of the alloy and a second shape different from the first shape at a temperature lower than Ms. The first and second shapes are rapidly and spontaneously recoverable in response to the thermal cycle between the higher and lower temperatures.

The Ti-Ni alloy article according to this invention is made by the following steps. Ti-Ni alloy ingot which consists essentially, by atomic percent, of 50.3-53.0 % Ni and the balance substantially Ti is prepared by the melting method. The ingot is subjected to a working process or processes to form an article of a predetermined size and shape. The worked alloy is heat-treated at a temperature of 600° C. or more to be made into a single phase of TiNi compound and quenched from the temperature. Then, the alloy is aged at a temperature below 600° C., preferably a temperature of 300° C.-500° C., more preferably 400° C.-500° C., under mechanical constraint for deforming into a first shape, and quenched in water or oil from the aging temperature. The alloy is changed by the aging into the dual phase structure of an intermetallic compound phase of TiNi and a precipitated compound phase of $TiNi_3$. The resultant alloy article has the first deformed shape at a temperature higher than As and a second shape changed spontaneously from the first shape at a temperature lower than Ms, and the first and second shapes are spontaneously recoverable in response to the thermal cycles between the higher and lower temperatures.

Further objects, features and other aspects of this invention will be understood from the following detailed description of preferred embodiments of this invention referring to the accompanying drawings.

BRIEF DESCRIPTION OF THE DRAWINGS

FIG. 5*a* is a side view of a specimen of Ti-Ni alloy as worked;

FIG. 5*b* is a side view of the specimen fixedly wound onto a pipe under constraint;

FIG. 6 is a view for illustrating shape changes of four specimens as aged at 300° C., 400° C., 500° C. and 600° C., in response to thermal cycles between a higher temperature and a lower temperature;

DETAILED DESCRIPTION OF PREFERRED EMBODIMENTS

Generally speaking, Ti-Ni alloy having S.M.E. or shape memory Ti-Ni alloy is made by the steps of, preparing the alloy by the melting method, working the alloy by working processes such as hot-working process and/or cold-working process, subjecting it to the strain relief treatment or the homogenizing heat treatment, for example, at about 700° C. for one hour, and heat-treating it at 600° C.-800° C. for one hour to make it into a single phase of TiNi compound followed by quenching it in water or oil from the heat-treating temperature. In some cases, the strain relief treatment and the heat treatment for making the single phase of TiNi compound may be performed by a single heat treatment.

With respect to alloys containing excess Ni over the stoichiometric composition, it is known in the prior art that the Ms is lowered considerably in dependence on the excess amount of Ni when the alloys are quenched from the high temperature condition where they have a single phase of TiNi compound, as disclosed in the paper "Effect of Heat Treatment on the Martensitic Transformation in TiNi Compound" by Honma and Takei, Journal of Japan Institute of Metals, Vol. 39 No. 2 (1975), p.p. 175-182.

As will be understood from FIG. 5 of the paper by Honma and Takei, the Ms of 50.0 at. % Ti-50.0 at. % Ni ($Ti_{50}Ni_{50}$) alloy is constant in no relation to the quenching temperature, but with respect to 49.0 at. % Ti-51.0 at. % Ni ($Ti_{49}Ni_{51}$) alloy and 48.0 at. % Ti-52.0 at. % Ni ($Ti_{48}Ni_{52}$) alloy, the Ms is lowered by elevation of the quenching temperature above 500° C. However, the Ms of $Ti_{49}Ni_{51}$ alloy becomes constant at quenching temperatures above 600° C., and that of $Ti_{48}Ni_{52}$ becomes constant at quenching temperature above 800° C.

In this connection, the martensitic transformation temperature Ms is defined as a temperature at a time when the electric resistivity of the alloy begins to rapidly decrease on cooling. The same definition is used in the description and claims in this specification.

Figure 8:
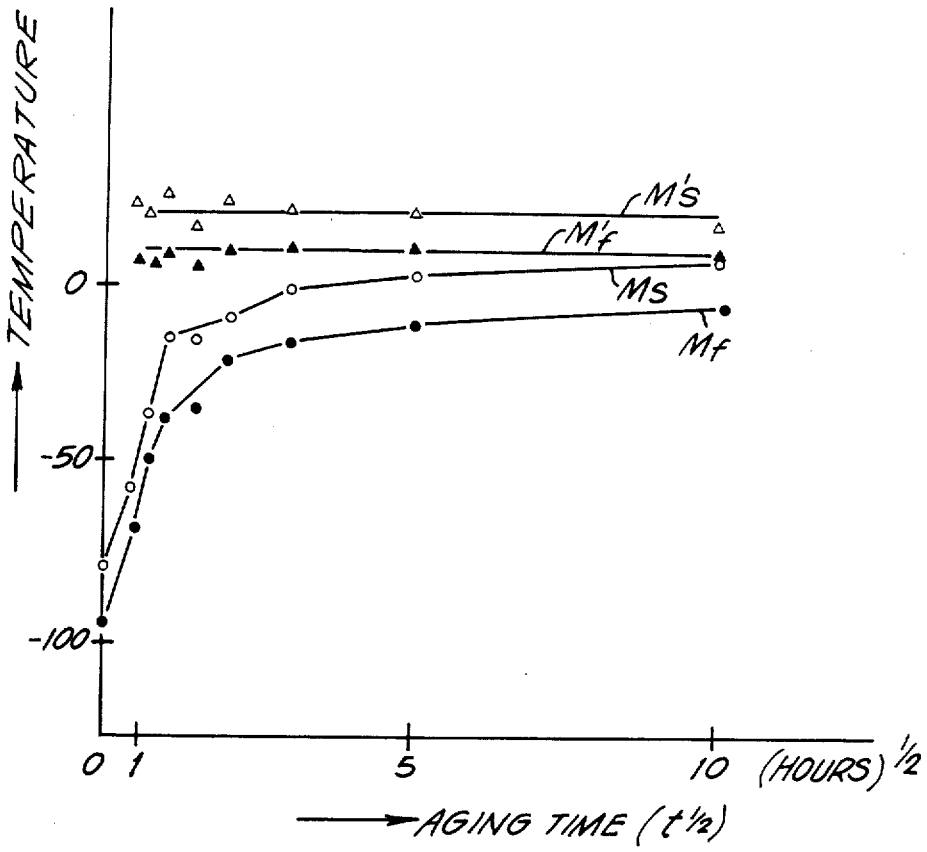
FIG. 8 shows variations of Ms, Ms', Mf and Mf' in relation to the aging time.

The paper by Honma and Takei also discloses that the Ms is raised up by aging the alloy (see FIG. 8 of the paper). The raise of the Ms is thought to be based on a fact that the excess Ni precipitates in a form of $TiNi_3$ compound into the matrix during the aging to reduce the Ni content in the matrix.

If the aging time is short or aging temperature is lower so that the excess Ni partially precipitates into the matrix, a temperature (Mf') at which the electric resistivity raised up on cooling and the Ms at which the electric resistivity decreases are present at points spaced from one another on the temperature axis. That is, two transformations are produced on cooling, in other words, two-step transformation is effected on cooling.

Figure 1:
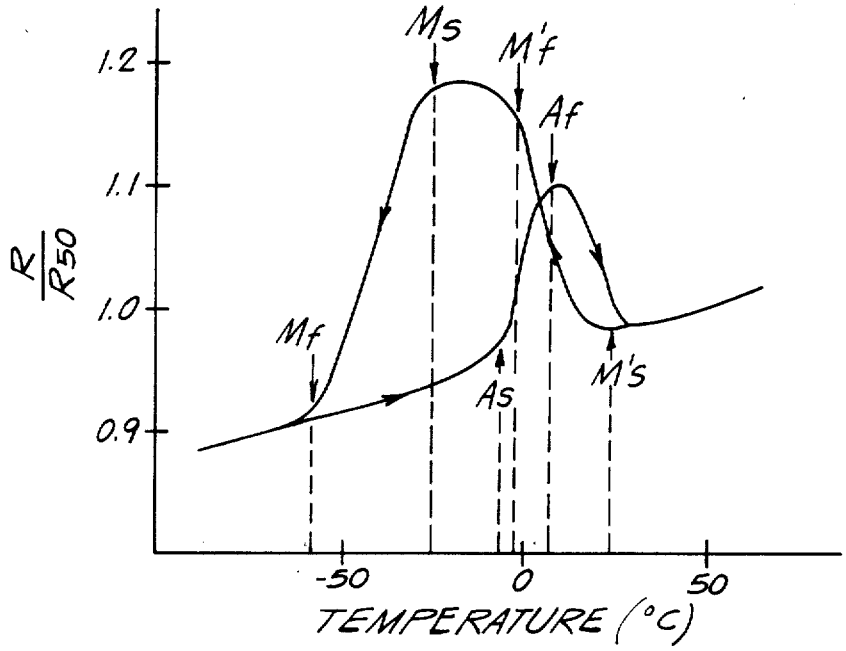
FIGS. 1 and 2 show the resistivity-temperature curve and the temperature characteristic of the differential scanning calorimetry (D.S.C.), respectively, of $Ti_{49}Ni_{51}$ alloy aged at 500° C. for two hours.
Figure 2:
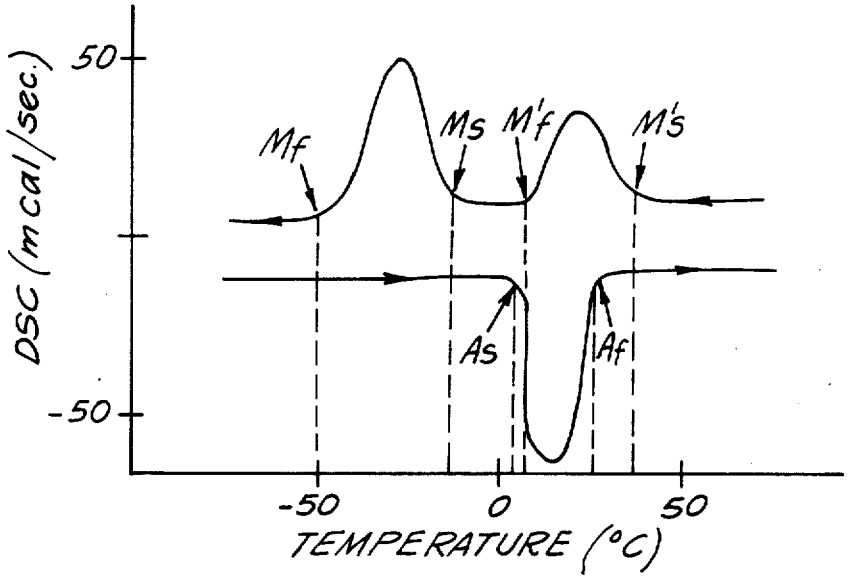

Now, an aging treatment at 500° C. for two hours followed by quenching it into water was applied to $Ti_{49}Ni_{51}$ alloy which was previously heat-treated to make the single phase of TiNi compound as described above, and the resistivity-temperature curve and the temperature characteristic of the differential scanning calorimetry (D.S.C.) were measured as to the alloy. The measured data are shown in FIGS. 1 and 2. In FIG. 1, the vertical axis represents resistivities (R) normalized by the resistivity ($R_{50}$) at 50° C. or $R/R_{50}$, and the horizontal axis represents temperatures (°C.). In FIG. 2, the vertical axis represents the D.S.C. (mcal/sec.) and the horizontal axis represents temperatures (°C.). It will be noted from FIGS. 1 and 2 that the aged alloy exhibits the two-step transformation on cooling. It is appreciated in the prior art that the increase of the resistivity on cooling is based on a phase transformation from the parent phase into the intermediate phase. The reverse transformation of the intermediate phase transformation also produces a resistivity decrease on heating. However, the reverse transformation of the intermediate phase transformation is present close to the reverse transformation of the martensitic transformation.

In FIGS. 1 and 2, six points of Ms, Mf, Ms', Mf', As and Af are referred to as martensitic transformation temperature, finish temperature for martensitic transformation, starting point for intermediate phase transformation, finish temperature for intermediate phase transformation, temperature for reverse transformation of the martensitic transformation and finish temperature for the reverse transformation, respectively.

On the other hand, in a condition where the excess Ni partially precipitates, it is appreciated that the Ni rich intermetallic compounds phase (for example $TiNi_3$) as precipitated has a strain field along the coherent interface with the matrix. This means that a stress concentration source to be able to control the martensitic transformation is introduced into the parent phase of the alloy.

Considering the above-described effects by aging the alloy containing excess Ni over the stoichiometric compound, this invention attempts to provide Ti-Ni alloy articles having an improved R.S.M.E. using the introduction of the stress cencentration source and the two-step transformation by aging the alloy.

Figure 3:
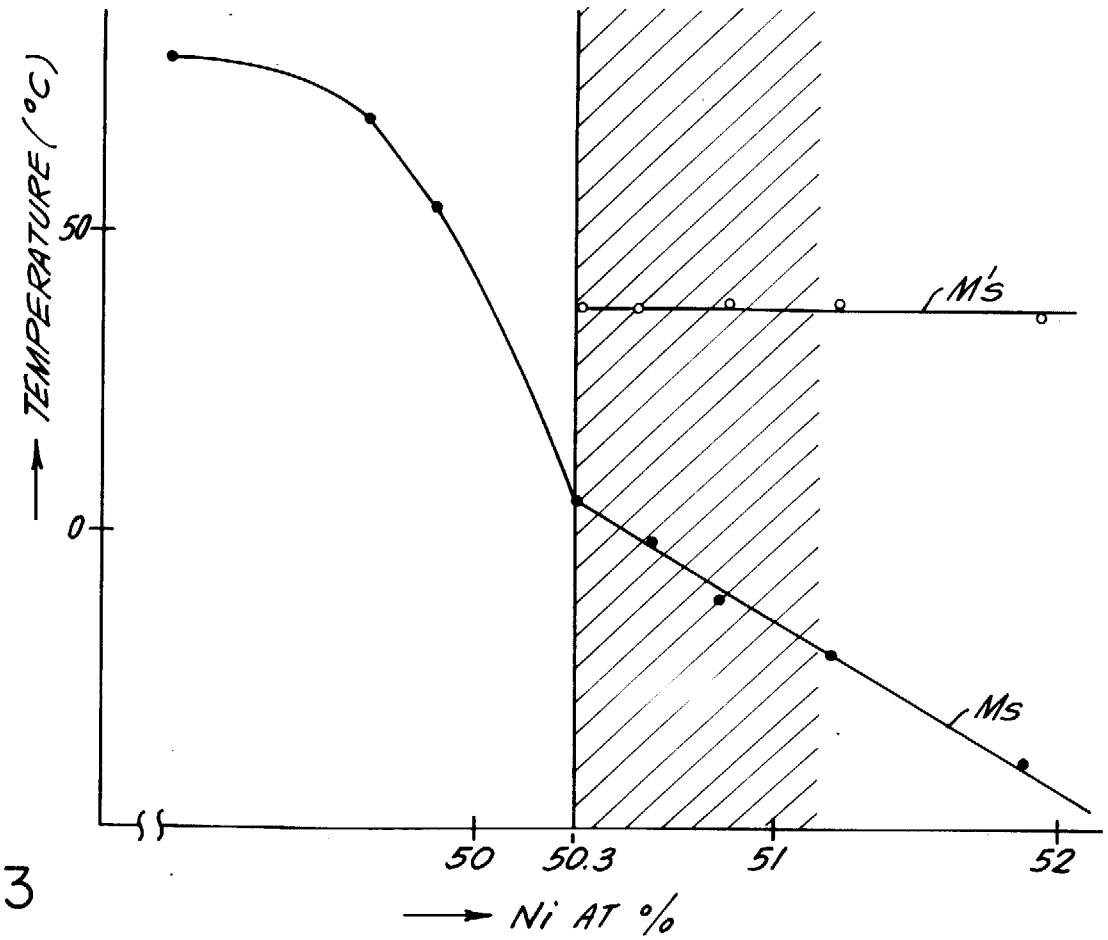
FIG. 3 shows variation of Ms and Ms' of Ti-Ni alloy in relation to various amounts of Ni content.

At first, an extent of Ni concents where the two-step transformation is produced by aging alloys was searched in connection with alloys of various Ni content and an aging at 500° C. for two hours. Variation of Ms and Ms' measured in relation to various amounts of Ni content are shown in FIG. 3. As will be noted from FIG. 3, Ms' is not present at a time when the Ni content is below 50.3 at. %. Therefore, it is understood that the Ni content is 50.3 at. % or more for obtaining the two-step concentration. Advantageously, the Ni content is 50.3–53.0 at. %.

Figure 4:
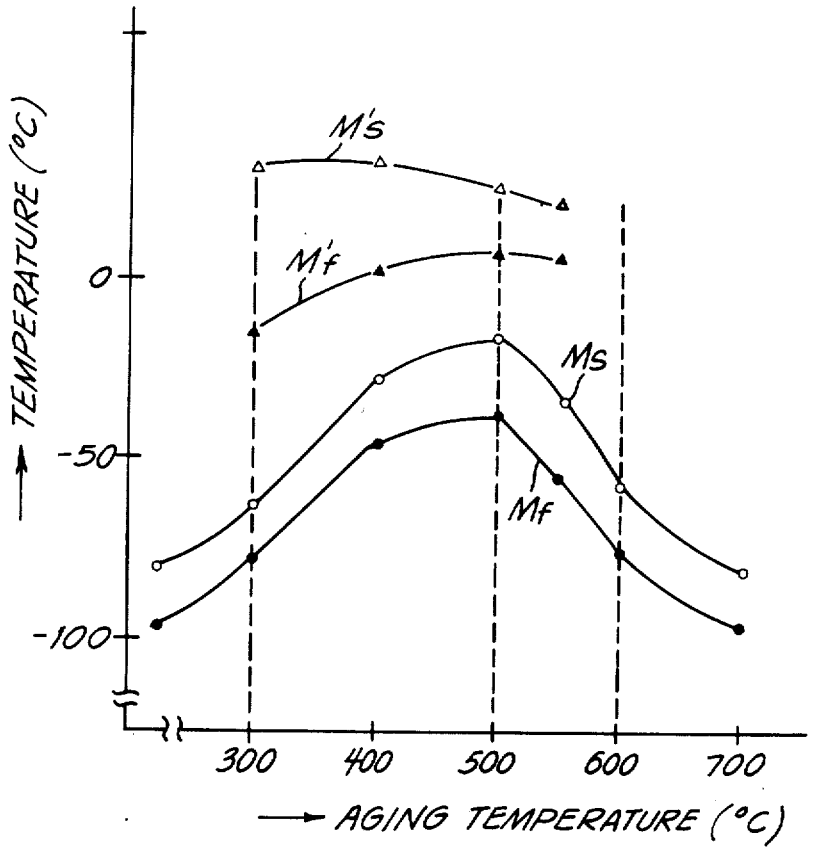
FIG. 4 shows variations of martensitic transformation temperature (Ms), intermediate phase transformation temperature (Ms') and finish temperatures (Mf, Mf') for these transformations of $Ti_{49}Ni_{51}$ in relation to the aging time.

Next, the aging temperature for obtaining the two-step transformation was examined. $Ti_{49}Ni_{51}$ alloys were aged at different temperatures for one hour followed by quenching, and Ms, Mf, Ms', and Mf' of respective alloys aged were measured. The obtained data are shown in FIG. 4. FIG. 4 teaches that an aging temperature below 600° C. is satisfactory for obtaining the two-step transformation. Advantageously, the aging temperature extent is 300° C.–500° C.

A feature of this invention is to age the Ti-Ni alloy of Ni content in the extent as described above at a temperature in the above-described temperature region under mechanical constraint to make a Ti-Ni alloy having an improved R.S.M.E.

Embodiments of this invention will be described below.

Strip specimens were obtained by cold-working ingots of $Ti_{49}Ni_{51}$ alloy produced by the melting method. The specimens were heat-treated at 800° C. to make into the single phase of TiNi compound and quenched in water. The specimens exhibit Ms of −83° C., and have the transformation pseudo-elasticity effect (T.P.E.) so that they are deformable under mechanical constraint but recover their original shapes upon being freed from the constraint.

Each specimen has a shape as shown by the side view in FIG. 5*a*, and is wound on a copper pipe and constrained in the condition by a suitable means such as a steel band, as schematically illustrated in FIG. 5*b*. If the constraint is freed, each specimen recovers the original shape as shown in FIG. 5*a*, due to the T.P.E.

Four specimens under the mechanical constraint were subjected to age-treatments for one hour at 300° C., 400° C., 500° C. and 600° C., respectively, and quenched in water. Those specimens were freed from the mechanical constraints after aging, and each specimen is cooled from the temperature higher than Af to a temperature lower than Mf, then heated to the temperature higher than Af again, and thereafter, again cooled to the temperature lower than Mf. During the cooling and heating cycles, shape changes of respective specimens were obserbed and are shown in FIG. 6.

Referring to FIG. 6, shapes of the four specimens aged which change in response to the thermal cycles are shown in respective columns at the tops of which the aging temperatures of respective specimens are described. Temperatures T at which the drawn shapes of each specimen were observed are described in relation to various temperatures Af, Mf, Af' and Mf' in the right side column. It will be noted from FIG. 6 that specimens aged at 400° C. and 500° C. change their shapes remarkably in response to the thermal cycles and similar shape changes are repeated. It should be noted that a circular shape at T>Af changes to a linear shape at Af>T>Mf' and further change to another circular shape at T>Mf which is deformed reversedly to the circular shape at T>Af. With respect to another specimen aged at 300° C., a slight shape change is observed, but the other specimen aged at 600° C. does not almost exhibit any shape change through the thermal cycle.

It will be also ascertained from FIG. 6 that the aging temperature for obtaining the reversible R.S.M.E. is below 600° C., preferably 300° C.–500° C., more preferably 400° C.–500° C.

According to this invention, the large amount of shape change is obtained as observed in connection with specimens aged at 400° C. and 500° C.

In order to confirm the degree of the shape change, the specimen aged at 500° C. for one hour was again tested under a thermal cycle where the specimen is cooled from 50° C. higher than Af of the alloy to −80° C. lower than Mf of the alloy and thereafter heated to 50° C. again. The shape change during the thermal cycle was observed, and variation of the shape change rate was observed and shown in FIG. 7.

In this connection, the shape change rate was defined by $r_H/r_T$, where $r_H$ is a radius of the specimen under the constraint, $r_T$ a radius of it at a temperature observed. When the shape of the specimen changes to a linear shape, $r_T=\infty$ and when it bends reversedly, $r_T$ takes a negative value.

Figure 7:
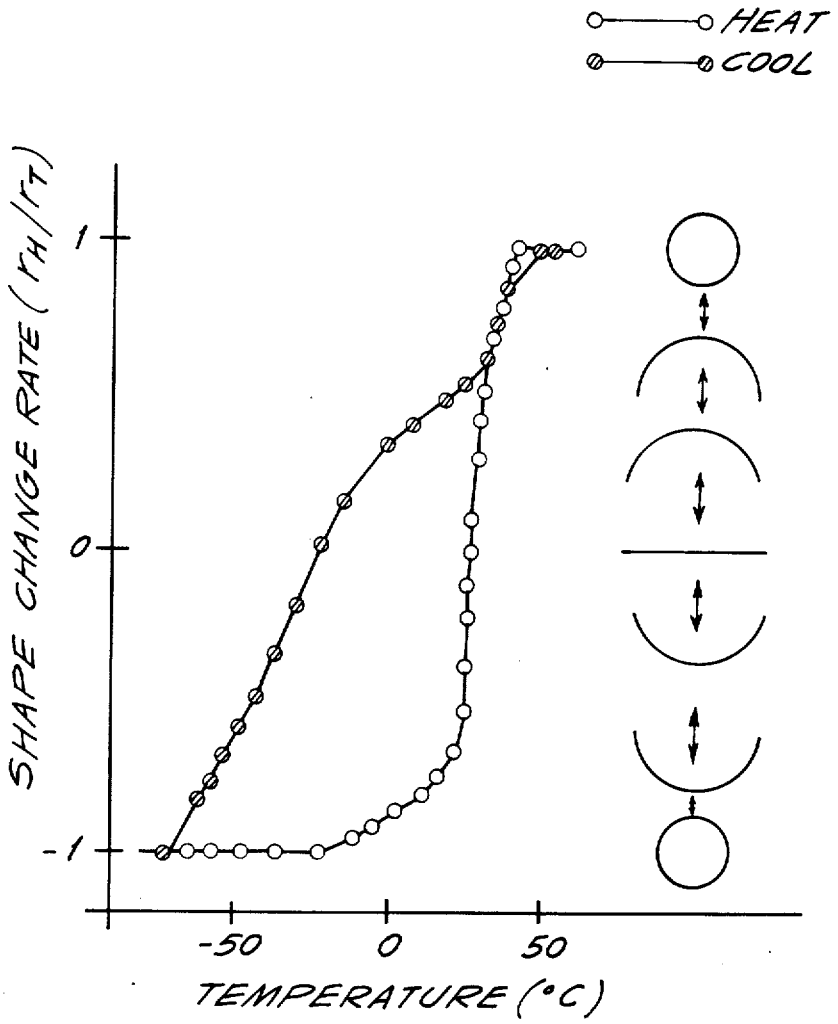
FIG. 7 shows variation of the shape change rate of the specimen aged at 500° C. in response to the thermal cycle.

In FIG. 7, shapes of the specimen corresponding to different shape change rates are drawn in addition to the curve of the shape change rate. It will be noted from FIG. 7 that a high shape change rate is attained according to this invention.

Referring to FIG. 7, the shape change is effected gradually on cooling but rapidly on heating. This can be explained by a fact that two transformations, that is, the intermediate phase transformation and the martensitic transformation, are spaced from one another on cooling, while the reverse transformations of them being very close to one another as described in connection with FIGS. 1 and 2.

Referring to FIG. 8, Ms and Mf are raised up by increase of the aging time (t) but are fixed more than about 25 hours. This will be appreciated that precipitation of Ni rich intermetallic compounds (for example $TiNi_3$) is completed by aging for about 25 hours.

On the other hand, the shape change on cooling was very small with respect to specimens aged at 500° C. for 16 hours or more. This means, according to our understanding, that the $TiNi_3$ phase grown reduced the coherency along the interface with the matrix and the interface strain disappears so that the stress concentration source for controlling the martensitic transformation cannot be sufficiently insured. Accordingly, the aging time should be selected within a range wherein not almost all but a part of the excess Ni precipitates, and preferably 16 hours at maximum.

What is claimed is:

1. A method of making a Ti-Ni alloy article having a reversible shape memory effect from a Ti-Ni alloy consisting essentially, by atomic percent, of 50.3–53.0% Ni and the balance substantially Ti, which comprises the steps of:

preparing an ingot of said alloy by the melting method;

working said alloy ingot into a predetermined size and shape;

heat-treating said worked alloy at a temperature of 600° C. or more to make said alloy into a single phase of TiNi compound, and quenching it in water or oil from the heat-treated temperature; and aging said alloy at a temperature below 600° C. but above 300° C. under mechanical constraint for deforming the alloy into a first shape and quenching the deformed alloy in water or oil from the aging temperature, to thereby provide said alloy with a dual phase structure of an intermetallic compound phase of TiNi and a precipitated Ni rich compound phase.

2. A method as claimed in claim 1, wherein the time for which said aging is carried out is selected so that only a part of the excess Ni in the alloy precipitates as the Ni rich compound.

3. A method as claimed in claim 2, wherein said aging time is less than 16 hours.

4. A method as claimed in claim 1, wherein said aging temperature is 300° C.-500° C.

5. A method as claimed in claim 1, wherein said aging temperature is 400° C.-500° C.

6. A method as claimed in claim 1, wherein said worked alloy is a strip, and said mechanical constraint is effected by fixedly winding said strip onto a pipe.

7. A method as claimed in claim 1, wherein the precipitated Ni rich compound comprises $TiNi_3$.

8. A Ti-Ni alloy article produced by the method of claim 11 and characterized in that said alloy article has a dual phase structure of an intermediate compound phase of TiNi and a precipitated Ni rich compound phase, whereby said article has a first memorized shape at a higher temperature than the finish temperature ($A_f$) for the reverse transformation of the martensitic transformation of said alloy and a second shape different from said first shape at a lower temperature than a temperature in the vicinity of the starting temperature ($A_S$) for the reverse transformation of the martensitic transformation, said first shape and said second shape being rapidly and spontaneously recoverable in response to thermal cycles between said higher and lower temperatures.

9. A Ti-Ni alloy article as claimed in claim 8, wherein said article is a strip, said strip achieving said first shape by bending in one direction, said second shape being linear, and said article has a third shape at a lower temperature than the martensitic transformation temperature ($M_s$) which is lower than said starting temperature ($A_s$), said third shape being obtained by bending in a reverse direction to the bending for said first shape.

* * * * *

UNITED STATES PATENT AND TRADEMARK OFFICE

CERTIFICATE OF CORRECTION

PATENT NO. : 4,707,196

DATED : November 17, 1987

INVENTOR(S) : Toshio Honma, et al.

It is certified that error appears in the above—identified patent and that said Letters Patent is hereby corrected as shown below:

On the title page Insert

Foreign Application Priority Data:

-- Feb. 27, 1982 [JP] Japan.....31605/1982 --

Signed and Sealed this

Twenty-first Day of June, 1988

*Attest:*

DONALD J. QUIGG

*Attesting Officer*

*Commissioner of Patents and Trademarks*